US005917433A

United States Patent [19]

Keillor et al.

[11] Patent Number: 5,917,433

[45] Date of Patent: Jun. 29, 1999

[54] ASSET MONITORING SYSTEM AND ASSOCIATED METHOD

[75] Inventors: Sharon A. Keillor, Hockessin, Del.; Frederick Michael Weaver, Charlotte, N.C.

[73] Assignee: Orbital Sciences Corporation, Dulles, Va.

[21] Appl. No.: 08/674,577

[22] Filed: Jun. 26, 1996

[51] Int. Cl.[6] ..... G08G 1/123

[52] U.S. Cl. ..... 340/989; 340/825.49; 340/626; 340/992; 340/540; 340/541; 340/577; 340/635; 340/636; 455/38.3; 342/457; 701/207

[58] Field of Search ..... 340/825.49, 989, 340/988, 626, 992, 540, 541, 577, 635, 630; 364/449.7; 455/38.3; 342/457

[56] References Cited

U.S. PATENT DOCUMENTS

| | | | |
|---|---|---|---|
| 3,568,161 | 3/1971 | Knickel | 340/992 |
| 3,683,366 | 8/1972 | Turpin, Jr. | 377/9 |
| 4,009,375 | 2/1977 | White et al. | 364/436 |
| 4,188,618 | 2/1980 | Weisbart | 340/870.16 |
| 4,258,421 | 3/1981 | Juhasz et al. | 364/424.04 |
| 4,350,969 | 9/1982 | Greer | 340/994 |
| 4,561,057 | 12/1985 | Haley, Jr. et al. | 364/436 |
| 4,651,157 | 3/1987 | Gray et al. | 342/457 |
| 4,688,026 | 8/1987 | Scribner et al. | 340/572 |
| 4,688,244 | 8/1987 | Hannon et al. | 377/58 |
| 4,701,760 | 10/1987 | Raoux | 340/993 |
| 4,706,086 | 11/1987 | Panizza | 340/902 |
| 4,745,564 | 5/1988 | Tennes et al. | 364/566 |
| 4,750,197 | 6/1988 | Denekamp et al. | 455/404 |
| 4,793,477 | 12/1988 | Manning et al. | 206/232 |
| 4,804,937 | 2/1989 | Barbiaux et al. | 340/459 |
| 4,831,539 | 5/1989 | Hagenbuch | 364/449.1 |
| 4,884,208 | 11/1989 | Marinelli et al. | 364/460 |
| 4,897,642 | 1/1990 | DiLullo et al. | 340/825.06 |
| 4,926,331 | 5/1990 | Windle et al. | 364/424.04 |
| 4,970,496 | 11/1990 | Kirkpatrick | 340/585 |
| 5,014,206 | 5/1991 | Scribner et al. | 364/449.1 |
| 5,017,926 | 5/1991 | Ames et al. | 342/353 |
| 5,025,253 | 6/1991 | DiLullo et al. | 340/825.06 |
| 5,068,656 | 11/1991 | Sutherland | 340/989 |
| 5,081,443 | 1/1992 | Breit | 340/426 |

(List continued on next page.)

OTHER PUBLICATIONS

America's Mobile Satellite Service ™, Corporate Overview, brocure.

Rockwell Mobile Communications brochure.

Omnitracs® Two–Way Satellite–Based Mobile Communications, Qualcomm, brochure.

*Primary Examiner*—Benjamin C. Lee

*Attorney, Agent, or Firm*—Alston & Bird LLP

[57] ABSTRACT

The asset monitoring system and associated method includes an asset monitor for providing a remotely located central station with information relating to a container, such as a trailer, both during tethered periods in which the energy storage reservoir of the asset monitor is electrically connected to an external power source, such as the electrical system of a tractor or truck, and during untethered periods in which the energy storage reservoir of the asset monitor is electrically untethered or disconnected from the external power source. As a result, the energy storage reservoir is recharged by energy received from the external power source during tethered periods and supplies energy to the asset monitor during both tethered and untethered periods. The asset monitor also includes a controller for controlling its operations. The controller includes tether status determining means for separately identifying tethered periods and untethered periods. The controller also includes power management means for placing the asset monitor in an active mode during tethered periods and in an energy conservation mode during untethered periods. Once placed in an energy conservation mode, the asset monitor can continue to draw power from the energy storage reservoir so as to perform selected ones of its operations. Typically, however, the asset monitor continues operations at a reduced rate or frequency relative to the rate of operations performed by the asset monitor during the active mode in order to conserve the energy stored by the energy storage reservoir.

31 Claims, 4 Drawing Sheets

U.S. PATENT DOCUMENTS

| | | | |
|---|---|---|---|
| 5,126,748 | 6/1992 | Ames et al. | 342/353 |
| 5,129,605 | 7/1992 | Burns et al. | 246/5 |
| 5,132,687 | 7/1992 | Baldwin et al. | 342/44 |
| 5,142,278 | 8/1992 | Moallemi et al. | 340/825.06 |
| 5,155,689 | 10/1992 | Wortham | 364/460 |
| 5,196,846 | 3/1993 | Brockelsby et al. | 340/933 |
| 5,223,844 | 6/1993 | Mansell et al. | 342/357 |
| 5,299,132 | 3/1994 | Wortham | 364/460 |
| 5,319,698 | 6/1994 | Glidewell et al | 379/39 |
| 5,347,274 | 9/1994 | Hassett | 340/988 |
| 5,359,528 | 10/1994 | Haendel et al. | 364/424.04 |
| 5,396,516 | 3/1995 | Padovani et al. | 375/225 |
| 5,398,190 | 3/1995 | Wortham | 364/460 |
| 5,400,018 | 3/1995 | Scholl et al. | 340/825.54 |
| 5,424,720 | 6/1995 | Kirkpatrick | 340/585 |
| 5,436,612 | 7/1995 | Aduddell | 340/438 |
| 5,442,810 | 8/1995 | Jenquin | 455/66 |
| 5,444,444 | 8/1995 | Ross | 340/994 |
| 5,475,597 | 12/1995 | Buck | 364/443 |
| 5,513,111 | 4/1996 | Wortham | 364/460 |
| 5,519,762 | 5/1996 | Bartlett | 455/576 |

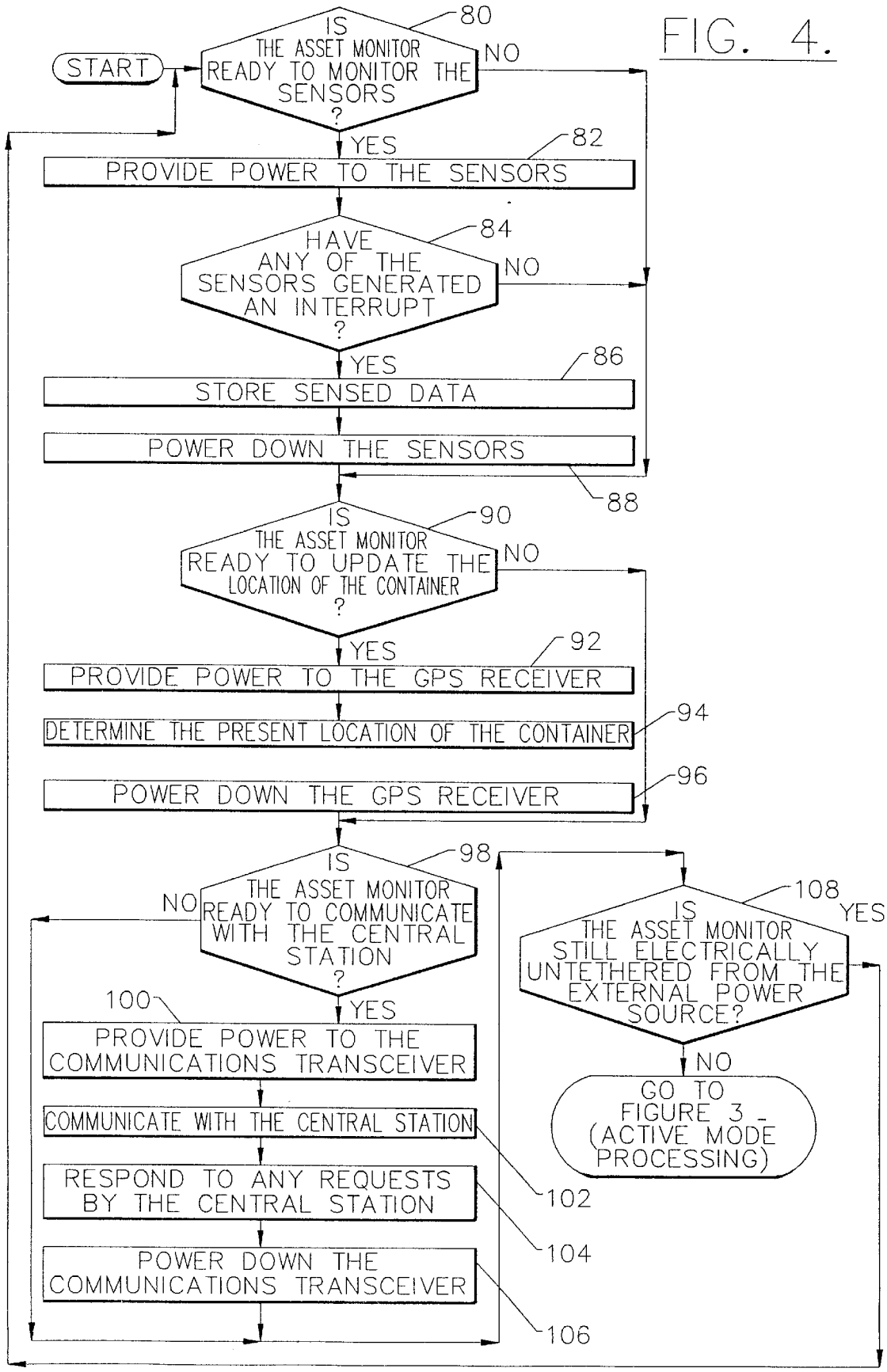
FIG. 4.
START
IS THE ASSET MONITOR READY TO MONITOR THE SENSORS ?
80
NO
YES
PROVIDE POWER TO THE SENSORS
82
HAVE ANY OF THE SENSORS GENERATED AN INTERRUPT ?
84
NO
YES
STORE SENSED DATA
86
POWER DOWN THE SENSORS
88
IS THE ASSET MONITOR READY TO UPDATE THE LOCATION OF THE CONTAINER ?
90
NO
YES
PROVIDE POWER TO THE GPS RECEIVER
92
DETERMINE THE PRESENT LOCATION OF THE CONTAINER
94
POWER DOWN THE GPS RECEIVER
96
IS THE ASSET MONITOR READY TO COMMUNICATE WITH THE CENTRAL STATION ?
98
NO
YES
PROVIDE POWER TO THE COMMUNICATIONS TRANSCEIVER
100
COMMUNICATE WITH THE CENTRAL STATION
102
RESPOND TO ANY REQUESTS BY THE CENTRAL STATION
104
POWER DOWN THE COMMUNICATIONS TRANSCEIVER
106
IS THE ASSET MONITOR STILL ELECTRICALLY UNTETHERED FROM THE EXTERNAL POWER SOURCE?
108
YES
NO
GO TO FIGURE 3 (ACTIVE MODE PROCESSING)

ASSET MONITORING SYSTEM AND ASSOCIATED METHOD

FIELD OF THE INVENTION

The present invention relates generally to asset tracking systems and associated methods and, more particularly, to asset monitoring systems and associated methods for monitoring the location and/or status of an asset, such as a container and its contents. As used herein, "container" includes open or enclosed trailers, rail cars, shipping containers, towed barges, offshore oil or gas rigs, mobile office or home trailers as well as other types of containers known to those skilled in the art.

BACKGROUND OF THE INVENTION

Each day, large quantities of freight which has a cumulative value of many millions of dollars are shipped throughout the United States and throughout the world. For example, large quantities of freight are loaded into rail cars and shipped by railroad. Likewise, large quantities of freight are stored in shipping containers and shipped by ship or barge. Even larger quantities of freight, however, is commonly loaded into trailers and shipped by truck.

Due to the quantity and the value of the freight, the owner of the freight as well as the shipper who has assumed custodial responsibility for the freight would like to track the position or location of the freight, regardless of its mode of transportation. Moreover, the owner of the freight as well as the shipper would oftentimes also like to monitor the status of the freight while the freight is in route. For example, it may be desirable to monitor the temperature of a refrigerated trailer in transport to insure that the refrigerated products stored within the trailer are appropriately chilled.

Accordingly, a variety of tracking systems have been developed which are designed to track the location and, in some instances, the status of freight during shipment. With respect to the trucking industry, however, these tracking systems typically track the location of the truck or tractor, and fail to track the location of the trailer, especially in instances in which the trailer is no longer attached to a tractor. In particular, conventional tracking systems are designed to track the location of the tractor since the tractor is generally worth many times more than an empty trailer.

For example, the earliest method of tracking the progress of a tractor-trailer required the driver to periodically park the tractor and to telephone the central station or dispatcher in order to report the present location of the tractor-trailer and to obtain updated delivery information. By requiring the driver to periodically telephone the central station or dispatcher, however, the average speed of the tractor-trailer was significantly reduced. In addition, the information relating to the present location of the tractor-trailer provided by the drivers was sometimes inaccurate due either to inadvertent mistakes or attempts by the driver to intentionally mislead the dispatcher regarding the progress of the tractor-trailer.

As a result, more sophisticated tracking systems have been developed which allow communications to be established between the driver of a tractor and a central station or dispatcher, while the tractor-trailer continues along its route. These tracking systems can also include a receiver mounted to the tractor for communicating with the Global Positioning System (GPS) satellites in order to determine the present location of the tractor-trailer. The tracking systems can then transmit information relating to the present position of the tractor-trailer to the central station or dispatcher without requiring the driver to stop the tractor-trailer and to telephone the central station or dispatcher.

Conventional tracking systems can also include one or more sensors for monitoring predetermined engine parameters, such as the oil pressure or engine temperature. Data representing these parameters can then be transmitted to the central station or dispatcher on an event-triggered, i.e., emergency, basis, on a regularly scheduled basis or as requested or polled. In addition, conventional tracking systems can include one or more sensors mounted within or upon the trailer in order to monitor predetermined conditions within the trailer, such as the temperature within a refrigerated trailer. In a like fashion, these tractor-based tracking systems can then transmit the sensory signals provided by the trailer sensors to the central station or dispatcher. Accordingly, conventional tracking systems can track the location of the tractor, while monitoring one or more predetermined engine or trailer conditions as the tractor-trailer continues along its route.

As described above, these conventional tractor-based systems can provide information relating to the location of the trailer and the status of the trailer and its contents only so long as the trailer is tethered to the tractor. Once the trailer has been untethered or unhitched from the tractor, however, conventional tracking systems can no longer track the location of the trailer and can no longer monitor the status of the trailer or its contents. Thus, even though conventional tracking systems have historically been thought to be sufficient due to the much greater cost of a tractor than an unloaded trailer, it has recently been observed that the trailer and the contents of the trailer are as valuable, if not more valuable, than the tractor. In addition, it has been found that a shipper can create significant customer distrust and ill-will by failing to adequately track and monitor the location and status of a trailer which contains the customer's freight, even after the trailer has been untethered or unhitched from the tractor. Conversely, substantial customer trust and loyalty could be established by a shipper if the shipper could accurately track and monitor the location and status of the customer's freight throughout the delivery process.

At best, conventional tracking systems may be able to identify the location of the trailer at the time at which the tractor was untethered or unhitched from the trailer. In some instances, however, the driver may neglect to identify or mark the exact location at which the trailer is parked, thereby making it relatively difficult, if not impossible, to locate the trailer. Notwithstanding the capabilities of conventional tracking systems, a trailer would also be difficult, if not impossible, to locate if the trailer were moved after the trailer was untethered from the tractor, such as in instances in which the trailer was stolen or otherwise moved without notifying the shipper or the owner of the freight. Accordingly, even shippers which equip their tractor-trailers with conventional tracking systems may be placed in the unenviable position of attempting to explain to the owner of lost freight why they are unable to locate the trailer in which their freight has been shipped.

SUMMARY OF THE INVENTION

It is therefore an object of the present invention to provide an asset monitoring system and associated method for tracking a container so as to identify the location of the container even after the container has been electrically untethered from an external power source.

It is another object of the present invention to provide an asset monitoring system and associated method for monitoring the status of a container and the contents of a container even after the container has been electrically untethered from an external power source.

These and other objects are provided, according to the present invention, by an asset monitoring system and associated method which includes an asset monitor for providing a remotely located central station with information relating to a container, such as a trailer, both during tethered periods in which the asset monitor is electrically connected to an external power source, such as the electrical system of a tractor or truck, and during untethered periods in which the asset monitor is electrically untethered or disconnected from the external power source. The asset monitor includes an energy storage reservoir which is recharged by energy received from the external power source during tethered periods and which supplies energy to the asset monitor during both tethered and untethered periods, thereby maintaining the asset monitor in operation during untethered periods.

The asset monitor also includes a controller for controlling its operations. According to the present invention, the controller includes tether status determining means for separately identifying tethered periods and untethered periods. The controller also includes power management means for placing the asset monitor in an active mode during tethered periods and in an energy conservation mode during untethered periods. Once placed in an energy conservation mode, the asset monitor selectively draws power from the energy storage reservoir so as to continue to operate, albeit typically at a reduced frequency or duty cycle. For example, the asset monitor typically performs operations during the energy conservation mode at a reduced frequency or a reduced duty cycle relative to the frequency or duty cycle at which operations are performed during the active mode in order to conserve the power stored by the energy storage reservoir. By detecting instances in which the container is electrically untethered from an external power source and by selectively controlling the frequency or duty cycle of the operations performed by the asset monitor during an untethered period, the asset monitor of the present invention can continue to operate, such as by monitoring one or more sensors, detecting the present position of the container and/or by communicating with the central station, even after the asset monitor has been electrically untethered.

The asset monitoring system and, in one embodiment, the asset monitor, include communications means, such as a communications transceiver, for establishing a first communications link between the asset monitor and the remotely located central station. The communications means of the asset monitor is adapted to transmit information, such as the location of the container, the status of the container and its contents and the effective time and date of the location and status information, to the central station via the first communications link, even during untethered periods.

The asset monitor of one advantageous embodiment of the present invention also includes a sensor interface for communicating with at least one sensor, such as a temperature sensor, a door position sensor a tire pressure sensor and/or a volume sensor. Each sensor is associated with the container and is adapted to provide a predetermined type of sensory signal. For example, each sensor can be adapted to provide a respective interrupt signal to the sensor interface, such as in instances in which the sensed condition or event falls outside of an acceptable range. Based on the interrupt signals provided by the sensors, the asset monitor can transmit a warning signal to the central station to alert the dispatcher to the sensed condition or event. In addition or instead of providing interrupt signals, the sensors can provide sensory signals which are indicative of the condition or event being monitored. The asset monitor can then process and/or store these sensory signals and can transmit these sensory signals to the central station, such as in instances in which the asset monitor determines that the sensory signals fall outside of an acceptable range.

The asset monitoring system can also include an operator interface which may, for example, be mounted within the cab of a tractor or truck. According to this advantageous embodiment, the communications means can also establish a second communications link between the asset monitor and the operator interface. Thus, the asset monitor and the operator or driver can exchange or transmit predetermined types of information. For example, the asset monitor can provide information relating to the present location of the container and the status of the container and its contents, such as by providing warning signals to the operator if the sensed conditions or events fall outside of an acceptable range. In addition, the asset monitor can pass messages between the central station and the operator interface, such as to provide warnings, revised directions or an updated itinerary.

The asset monitor can also include position determining means, such as a receiver, for receiving externally supplied location data indicative of the present position of the container. For example, the position receiver can include a GPS receiver for receiving location data from a plurality of GPS satellites from which the present position of the container can be determined. Accordingly, the asset monitor can transmit information identifying the present position of the container to this central station via the first communications link, even during untethered periods.

According to one advantageous embodiment, the asset monitor monitors the sensors, updates the location of the container and communicates with the central station only during predetermined intervals of time within an untethered period, as opposed to a relatively continuous basis during tethered periods. As a result, the asset monitor of the present invention effectively conserves the energy stored by the energy storage reservoir which powers the asset monitor during untethered periods without being recharged by the external power source.

Accordingly, the asset monitoring system of the present invention provides for the tracking and monitoring of containers, such as trailers, even in instances in which the containers are untethered or disconnected from an external power source. The asset monitoring system of the present invention can therefore readily locate untethered trailers which have been misplaced. In addition, by separately identifying tethered periods and untethered periods, the asset monitor can be placed in an active mode or an energy conservation mode, respectively, in order to conserve the energy stored by the energy stored reservoir, thereby allowing the asset monitor to provide extended, operations during an untethered periods, albeit typically at a reduced frequency or duty cycle relative to the operations performed during a tethered period.

BRIEF DESCRIPTION OF THE DRAWINGS

FIG. 4 illustrates the operations performed by the asset monitor of one embodiment of the present invention during untethered periods in which the asset monitor is in an energy conservation mode.

DETAILED DESCRIPTION OF THE PREFERRED EMBODIMENTS

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in art. Like numbers refer to like elements throughout.

Figure 1:
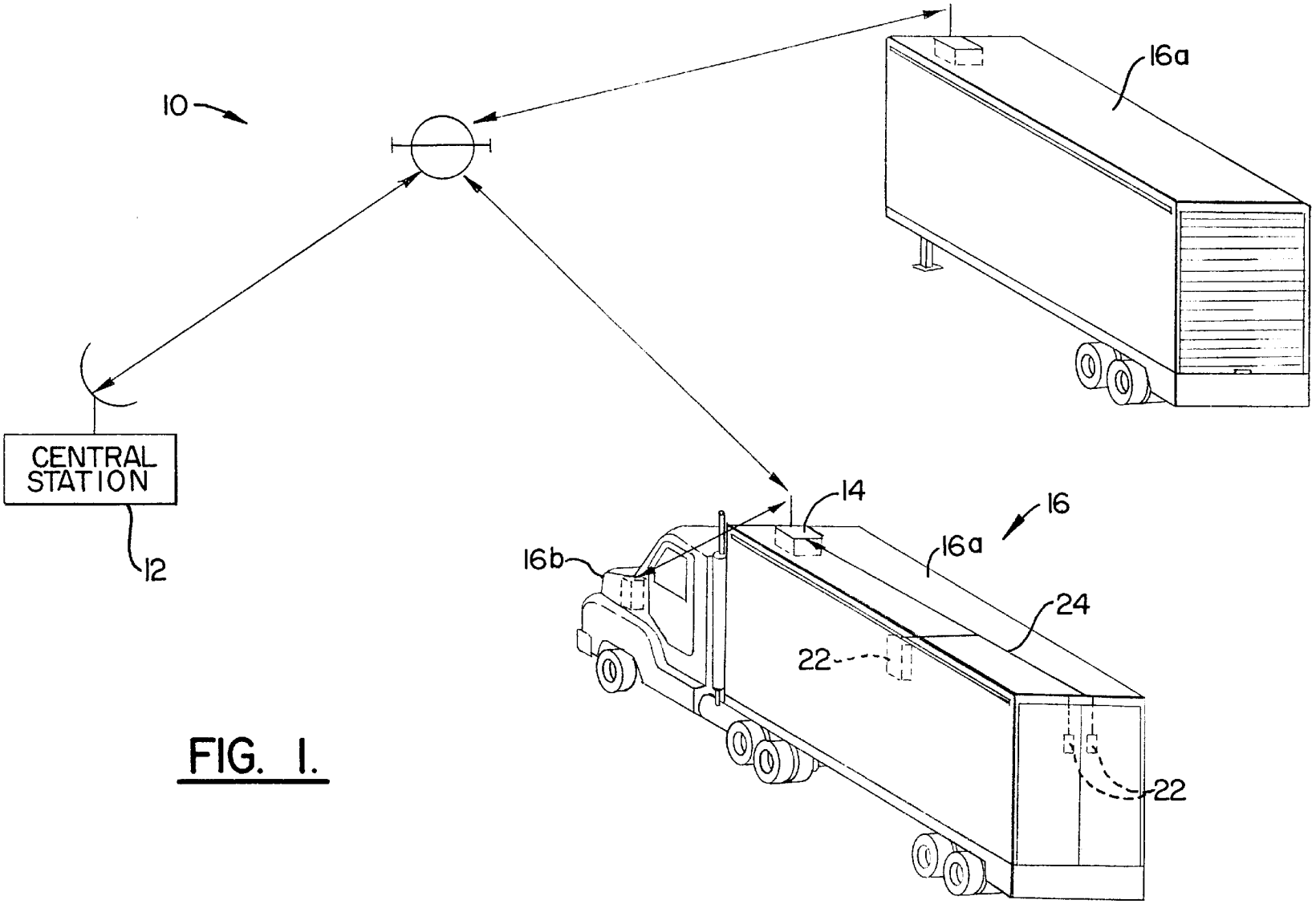
FIG. 1 is a diagrammatic illustration of an asset monitoring system according to one embodiment of the present invention.

Referring now to FIG. 1, an asset monitoring system 10 according to one embodiment of the present invention is illustrated. The asset monitoring system includes a central station 12 and one or more asset monitors 14 associated with respective containers 16. As illustrated in FIG. 1, for example, the containers can include one or more open or enclosed trailers 16*a* which are adapted to be hitched to and towed by respective tractors or trucks 16*b*. However, the containers can include other types of containers, such as rail cars, shipping containers, towed barges, offshore oil or gas rigs or mobile office or home trailers without departing from the spirit and scope of the present invention. By way of example, however, the asset monitoring system and associated method of the present invention will be described in more detail hereinafter in conjunction with the tracking and monitoring of trailers, although other types of containers could be effectively tracked and monitored by the asset monitoring system and method of the present invention.

As the above examples illustrate, the containers 16 preferably have the potential to be mobile. That is, the containers are preferably able to be moved from place to place. However, the containers are typically not able to move from place to place under their own power. Thus, even though a container may include a source of electrical power for performing a predetermined function, such as a generator for operating the refrigeration unit of a refrigerated trailer, the container generally requires an external power source in order to be moved from place to place.

As shown in FIG. 1, an asset monitor 14 is associated with and mounted to a respective container 16, such as respective trailer 16*a*. The asset monitor can be mounted to the container in a number of manners without departing from the spirit and scope of the present invention. For example, the asset monitor of the present invention can be mounted to the exterior of the container, within the container or within the walls of the container. Although the asset monitor can be permanently mounted to the container, the asset monitor can also be temporarily mounted to a container. For example, an asset monitor can be temporarily mounted to a rental trailer in order to monitor the location and status of the rental trailer and its contents. As also shown in FIG. 1 and as described hereinafter, the asset monitor is adapted to communicate, via a first communications link, with a remotely located central station 12 so as to provide the central station with information relating to the container with which the asset monitor is associated.

As known to those skilled in the art, a trailer 16*a* is typically electrically connected to the electrical system of a respective tractor 16*b* once the tractor and trailer have been tethered or hitched. Accordingly, the electrical system of the tractor which generally includes the battery, the generator and the alternator can provide electrical energy to the trailer for operating the trailer lights and other electrical systems of the trailer, such as a refrigeration system for a refrigerated trailer.

Figure 2:
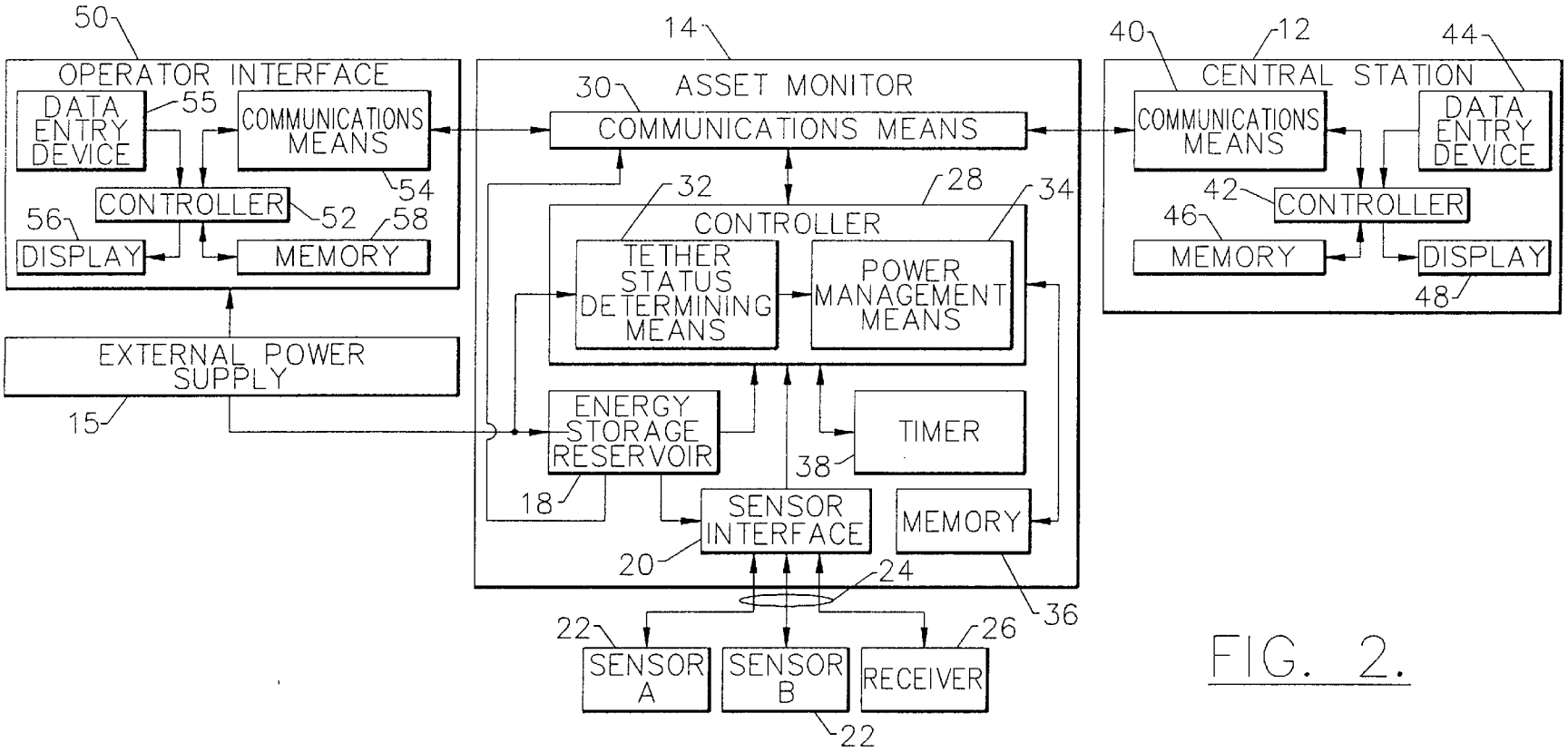
FIG. 2 is a block diagram representation of an asset monitoring system according to one embodiment of the present invention which illustrates the asset monitor, the central station, the operator interface and the external power source.

According to the present invention, the asset monitor 14 is sometimes electrically connected to an external power source 15 as shown in FIG. 2. For example, for an asset monitor mounted within a trailer 16*a*, the asset monitor can be electrically connected to the electrical system of the respective tractor 16*b* once the tractor and trailer have been tethered. However, other types of external power sources, such as one or more solar panels or the electrical system of a ship or barge, can provide the necessary power without departing from the spirit and scope of the present invention. In addition, the external power source can include a generator disposed within the container, such as for operating the refrigeration unit of a refrigerated trailer. Thus, the external power source need not be external to the container, but merely external to the asset monitor.

As shown in FIG. 2, the asset monitor 14 includes an energy storage reservoir 18, such as one or more batteries or a capacitor bank, which is electrically connected to an external power source 15, such as the electrical system of a tractor 16*b*, during tethered periods in which the asset monitor is electrically tethered or electrically connected to the tractor. Thus, during tethered periods, an electrical path is not only established between the asset monitor and the external power source, such as via one or more electrical wires, but the external power source also supplies power, via the electrical path, to the energy storage reservoir of the asset monitor. Therefore, even though a tractor and a trailer 16*a* may remain physically coupled, the energy storage reservoir of the asset monitor is no longer electrically tethered to the external power source, i.e., the electrical system of the tractor, if the external power source is not providing power to the energy storage reservoir of the asset monitor.

During the tethered periods, however, the energy storage reservoir 18 of the asset monitor 14 is recharged by energy received from the external power source 15, such as the electrical system of the tractor 16*b*. As described below, the energy storage reservoir supplies energy to the asset monitor both during tethered periods in which the energy storage reservoir is continually recharged and untethered periods in which the asset monitor is electrically untethered or electrically disconnected from the external power source. In other words, during untethered periods, the asset monitor is no longer supplied power by the external power source. Due to the energy provided by the energy storage reservoir, however, the asset monitor of the present invention can continue operations during untethered periods, as described in more detail below. Although not illustrated, the asset monitor can also include a spike protection and regulation circuit disposed upstream of the energy storage reservoir to appropriately filter the electrical energy received from the external power source and to protect the asset monitor from spikes or other undesirable power surges.

The asset monitor 14 also preferably includes a sensor interface 20, such as a multi-port input/output interface, for providing communications with at least one and, more commonly, several sensors 22 which are associated with the trailer 16*a* and/or the tractor 16*b*. Each sensor is adapted to monitor a predetermined condition or event and to provide a predetermined type of sensory signals. For example, the sensors can include temperature sensors disposed within predetermined portions of the trailer in order to monitor the temperature within the respective portions of the trailer. The sensors can also include door position sensors, such as Sentrol 2202 Series miniature overhead door contact sensors, for monitoring the relative position of the doors, i.e., for determining whether the doors are open or closed. In addition, the sensors can include audio and/or optical sensors for monitoring the noise level within a trailer and for providing video signals representative of the interior of the trailer, respectively. In addition to the above examples, the sensor interface of the asset monitor of the present invention can be adapted to communicate with a variety of other types of trailer sensors, such as tire pressure sensors, volume sensors, motion and/or acceleration sensors, hazardous material sensors, and radio frequency (RF) tags, without departing from the spirit and scope of the present invention.

Although the asset monitor 14 can be adapted to receive various types of sensory signals, the sensors 22 of one advantageous embodiment are designed to provide interrupt signals to the asset monitor upon the detection of a predetermined event. For example, the sensors can be designed to compare the sensed condition to a predetermined range of acceptable conditions. If the sensor of this advantageous embodiment detects that the sensed condition exceeds or falls outside of the predetermined range of acceptable conditions, the sensor can generate an interrupt signal which is provided, via the sensor interface 20, to the asset monitor, thereby alerting the asset monitor that the sensed condition is no longer within acceptable limits. For example, the temperature sensor can compare the sensed temperature to the predetermined range of acceptable temperatures and, if the sensed temperature falls outside of the predetermined range of acceptable temperatures, can generate an interrupt signal. In addition, the door sensor may be designed to generate an interrupt signal if the door sensor detects that the door is opened or closed. The range of acceptable conditions can be selected or set in a variety of manners without departing from the spirit and scope of the present invention. For example, the range of acceptable conditions can be downloaded from the central station 12 to the asset monitor while the asset monitor is in the field, such as via the first communications link as described hereinafter.

In addition to or instead of generating interrupt signals, the sensors can provide sensory signals indicative of the measured condition, such as the temperature within a refrigerated or unrefrigerated trailer, and/or sensory signals which provide additional details of the sensed condition, such as the relative condition of a door. Based upon this type of sensory signal, the asset monitor and/or the central station can store data relating the sensory signals and can monitor the sensed condition, such as to detect trends or to determine if the sensed condition is within acceptable limits, as described below.

Typically, the sensors 22 are electrically connected to the asset monitor 14 via the sensor interface 20. For example, an electrical bus 24, such as an RS485 electrical bus can interconnect each of the sensors and the sensor interface. However, the sensors can be electrically connected to the asset monitor in a variety of other fashions without departing from the spirit and scope of the present invention. For example, the sensor interface can include an RF, infrared (IR) or audio transceiver for communicating with the sensors via local RF, IR or audio communications links, respectively.

According to one advantageous embodiment, the asset monitor 14 includes position determining means, typically including a receiver 26, which is operably connected to the asset monitor 14, either directly or via the sensor interface 20 as shown in FIG. 2. The position determining means determines the position of the container 16, i.e., the trailer 16*a*, based upon externally supplied location data. According to one advantageous embodiment, the position determining means includes a GPS receiver, such as GPS receiver model number 24080-61 manufactured by Trimble Navigation Limited of Sunnyvale, Calif., for receiving signals from a plurality of GPS satellites. Alternatively, the position determining means can include a receiver which is adapted to communicate with one or more LORAN land-based transmitters. Still further, the position determining means can be responsive to location data entered or provided by the operator. Based upon the externally supplied location data, the position determining means can determine the current position of the trailer and can report the current position to the asset monitor.

The asset monitoring system 10 of the present invention also includes communications means for establishing a first communications link between each respective asset monitor 14 and the remotely located central station 12. The communications link supports bidirectional communications and can either be a direct link or can be comprised of a chain of communications links which are linked to create the resulting first communications link. As illustrated in FIG. 2, the communications means of the asset monitoring system is typically distributed such that the central station as well as each asset monitor includes at least portions of the communications means, as described hereinbelow. Once the communications means has established the first communications link between the central station and an asset monitor, the respective asset monitor can transmit information related to the location of the trailer 16*a* and information relating to the sensory signals to the central station. Based upon the information provided via the first communications link, the central station can monitor the position of the trailer and status of the trailer and its contents as described below.

Although not illustrated, the communications means can also establish another communications link between the asset monitor 14 and an emergency services dispatcher, such as a "911" dispatcher, in the vicinity of the asset monitor. Accordingly, the asset monitor can transmit information via this other communications link to the emergency services dispatcher if an emergency occurs. For example, an asset monitor can transmit information to the emergency services dispatcher via this other communications link if the hazardous materials sensor detects the presence of certain types of hazardous materials within the container 16. The emergency services dispatcher can then quickly dispatch assistance to the operator or driver. In addition to or instead of notifying an emergency services dispatcher of the emergency conditions, the asset monitor can notify the operator or driver of the emergency conditions, such as via the second communications link established between the asset monitor and an operator interface 50 as described hereinbelow.

In one advantageous embodiment, a single tractor 16*b* may tow a number of trailers 16*a*, such as two or three trailers. While each trailer can include an asset monitor 14 which independently communicates, via distinct communications links, with the central station 12, the asset monitoring system 10 of this advantageous embodiment can include a master asset monitor mounted within one of the trailers, such as the trailer directly tethered to the tractor, and one or more slave asset monitors mounted within respective ones of the other trailers. According to this advantageous embodiment, the slave asset monitors can each include communications means, such as a local RF transceiver, for communicating with the master asset monitor and for providing the master asset monitor with information relating to the sensory signals collected from the sensors on-board the respective trailers. The master asset monitor can thereafter establish a first communications link with the central station and can provide the central station with information related to the sensory signals collected by each of the asset monitors, namely, the master asset monitor and each of the slave asset monitors. In addition, since all of the trailers will be at the same location, only the master asset monitor must generally include position determining means. Thus, the cost and complexity of the slave asset monitors can be reduced relative to the master asset monitor.

The communications means can utilize various types of communications technology, such as satellite, RF, soft radio, cellular or packet radio communications technology, to establish the first communications link without departing from the spirit and scope of the present invention. For example, the asset monitor 14 and the central station 12 can each include a transmitter and a receiver, hereinafter termed a transceiver, for transmitting data via a terrestrial digital data network, such as via a RAM Mobile communications link established between the asset monitor and the central station. Alternatively, the asset monitor and the central station can each include a transceiver for establishing a satellite communications link, as illustrated schematically in FIG. 1. Alternatively, the asset monitor and the central station can each include a radio frequency (RF) transceiver for establishing an RF communications link. Still further, the asset monitor and the central station can be directly connected, either electrically or optically, without departing from the spirit and scope of the present invention.

As shown in FIG. 2, the asset monitor 14 of the present invention also includes a controller 28 for controlling operations of the asset monitor and, more particularly, for controlling operations of the energy storage reservoir 18, the sensor interface 20 and the communications means 30. As illustrated in FIG. 2, the controller includes tether status determining means 32 for separately identifying tethered periods and untethered periods. For example, the tether status determining means can monitor the electrical connection between the external power source 15, such as the electrical system of the associated tractor 16*b*, and the energy storage reservoir of the asset monitor to separately identify tethered periods in which the asset monitor is supplied with power from the external power source and untethered periods in which the asset monitor is not supplied with power from the external power source.

As illustrated in FIG. 2, the controller 28 also includes power management means 34, responsive to the tether status determining means 32, for controlling the power consumption of the asset monitor 14. In particular, the power management means places the asset monitor in an active mode during the tethered periods and an energy conservation mode during untethered periods. As described in detail hereinafter, the energy storage reservoir 18 of the asset monitor is recharged by the external power source 15, i.e., the electrical system of the tractor 16*b*, during the active mode, even though the energy storage reservoir 18 supplies energy to power the asset monitor and the associated sensors 22 during both the active and energy conservation modes. Thus, in order to extend the operating lifetime of the asset monitor following disconnection or untethering of the asset monitor from the external power source, the power management means selectively controls the operations performed by the asset monitor during the energy conservation mode, such as by typically reducing the frequency or duty cycle of the operations performed by the asset monitor during the energy conservation mode relative to the active mode.

As described above, the controller 28, including the tether status determining means 32 and the power management means 34, are preferably implemented by a combination of hardware and software. For example, the controller 28 can be implemented by one or more controllers or processors, such as a Motorola 68331 microcontroller, as well as one or more related memory elements 36 which operate under the control of software to provide the tether status determining and power management functions described above. The software is typically stored in the microcontroller as well as one or more related memory elements prior to operation of the asset monitoring system 10, such as prior to the departure of a tractor-trailer on a trip. However, the software is preferably downline loadable from the central station 12 such that the central station can revise certain parameters within the controller or can essentially reprogram the controller with a new or revised version of the software while the asset monitor 14 is remotely located from the central station.

Figure 3:
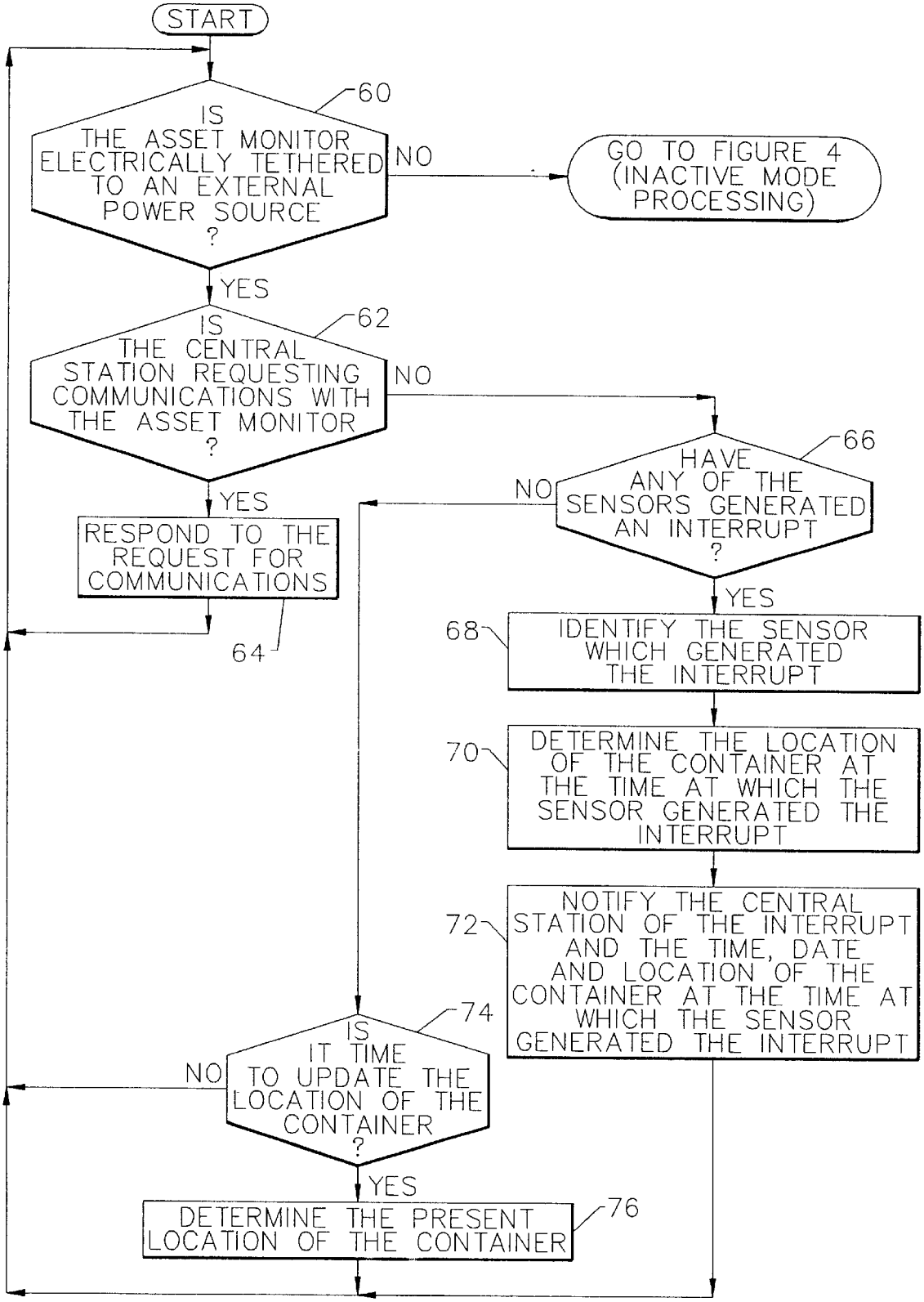
FIG. 3 illustrates the operations performed by the asset monitor of one embodiment of the present invention during tethered periods in which the asset monitor is in an active mode.

Referring now to FIGS. 3 and 4, the operations of one exemplary embodiment of the asset monitor 14 of the present invention are depicted for purposes of illustration. As will be apparent to those skilled in the art, however, the types of operations performed by the asset monitor and the order in which the operations are performed by the asset monitor can be altered without departing from the spirit and scope of the present invention. As a result, the operations illustrated in FIGS. 3 and 4 are provided for purposes of illustration and not of limitation.

As shown in block 60 of FIG. 3, the asset monitor 14 and, more particularly, the controller 28 of one advantageous embodiment initially determines if the asset monitor is electrically tethered or electrically connected to an external power source 15, such as the electrical system of a tractor 16*b*. If the asset monitor is electrically tethered to an external power source, the asset monitor continues to operate in the active mode as shown in FIG. 3. Alternatively, if the asset monitor is electrically untethered or disconnected from the external power source, the asset monitor is placed in the energy conservation mode as shown in FIG. 4 and described below.

During tethered periods, the asset monitor 14 monitors the communications transceiver 30 on a frequent, if not continuous, basis to determine if the remotely located central station 12 is attempting to communicate with the asset monitor. As shown in blocks 62 and 64, if the asset monitor determines that the central station is attempting to establish communications, the asset monitor receives and processes the communications signals which were transmitted by the central station and, based upon the received signals, responds accordingly. For example, the central station may request that the asset monitor identify its present position. Upon receiving this request from the central station, the asset monitor can prompt the position determining means, such as a GPS receiver 26, to determine the present location of the asset monitor. Thereafter, the asset monitor can transmit information to the central station, via the first communication link, which identifies the present location of the asset monitor, typically by latitude and longitude.

As a further example, the central station 12 may request an update on the status of the various sensors 22. Accordingly, the asset monitor 14 can determine if any of the sensors have generated an interrupt since the last update and, if so, the asset monitor can transmit information to the central station which defines the sensor which generated the interrupt and the time and date of the interrupt, for example. The central station can thereafter process and store the sensed data as described below. Alternatively, the asset monitor can transmit information relating to the actual condition or event which was sensed, such as the temperature of a refrigerated trailer, or well or the time and date of the sensed condition or event for analysis by the central station.

In addition to frequently, if not continuously, monitoring the first communications link while in the active mode, the asset monitor 14 repeatedly monitors the sensors 22. As described above, the sensors preferably generate an interrupt upon the detection of a condition or event which falls outside of a predetermined accepted range. Thus, as shown in blocks 66–70 the asset monitor initially determines if any sensor has generated an interrupt and, if so, determines the location of container 16 at the time of the interrupt, such as prompting the position determining means to pinpoint the current location of the container. As shown in block 72, the asset monitor can then notify the central station 12, via the first communications link, of the interrupt and the location of the container at the time of the interrupt. In addition, the asset monitor can provide information relating to the actual condition or event which was sensed, such as the temperature of a refrigerated or unrefrigerated trailer, for example. The central station can then respond, also via the first communications link, with a message which details the corrective action which is recommended to cure or alleviate the unacceptable condition which was detected by the sensor which generated the interrupt. Although not illustrated, the sensory data, including an identification of the sensor generating the interrupt, the location of the container at the time of the interrupt and any other data relating to the actual condition or event which was sensed, can also be stored, such as within the memory device 36 associated with the controller 28.

As shown in FIG. 2, the asset monitor 14 can also include a timer 38. Accordingly, the asset monitor can determine the time and date at which an interrupt was generated by the sensors 22. The asset monitor can thereafter store and/or provide the central station 12 with the time and date at which the interrupt was generated. Although the controller 28 and the timer are illustrated as separate components, the controller can include an internal timer or the timing function can be implemented with software without departing from the spirit and scope of the present invention.

In addition to frequently monitoring the sensors 22 and the communications receiver 30, the asset monitor 14 of one advantageous embodiment also frequently determines the location of the container 16, such as at predetermined time intervals. As shown in blocks 74 and 76 of FIG. 3, the asset monitor 14 of this embodiment can therefore also determine if it is time to update the location of the container and, of so, can prompt the position determining means to update the position of the asset monitor. The asset monitor can thereafter transmit information which identifies the updated location to the central station 12 or the asset monitor can store the updated location until the central station subsequently requests an update of the location of the container, at which time the asset monitor can provide the central station with the most recent location of the container.

As illustrated in FIG. 3 and as described hereinabove, the operations performed while the asset monitor 14 is in the active mode may be relatively continuous since the energy storage reservoir of the asset monitor is continually being recharged by the external power source 15. For example, the asset monitor monitors the first communications link and the sensors 22 on a very frequent, if not continuous, basis during the active mode of operation. In contrast, the operations performed by the asset monitor in the energy conservation mode, including communications with the central station 12, monitoring of the sensors and updating of the location of the container 16, are selectively controlled by the controller 28 in order to conserve the limited power stored by the energy storage reservoir 18. According to one advantageous embodiment, the controller significantly reduces the frequency or duty cycle of the operations performed by the asset monitor during the energy conservation mode relative to the active mode in order to effectively extend the period of time during which the asset monitor can maintain operations once the asset monitor has been untethered from the external power source, such as the tractor 16*b*.

As illustrated in FIG. 4, the asset monitor 14 is placed in energy conservation mode once it is determined that the asset monitor is no longer tethered to an external power source 15, e.g., once it is determined that the trailer 16*a* is no longer electrically tethered to the tractor 16*b*. According to one advantageous embodiment, the asset monitor, once in energy conservation mode, monitors the sensors 22, updates the location of the container 16 and communicates with the central station 12 during predetermined intervals of time, such as one minute every hour or every four hours. It should be noted, however, that the predetermined intervals of time during which the asset monitor preforms each of its different functions, i.e., monitors the sensors, updates the location of the container and communicates with the central station, can be the same or can be different according to an operator defined task frequency list. In addition, the predetermined intervals of time need not remain the same over time, but can be changed according to an operator defined schedule over time, such as in response to predetermined types of sensed events or conditions.

It will be apparent to those skilled in the art, however, that the asset monitor 14 of the present invention can be configured to perform the same operations at the same frequency during the energy conservation mode as the active mode, if so desired. Typically, however, the asset monitor performs selected ones of its functions at predetermined intervals of time as shown in FIG. 4 and described below until the asset monitor senses and/or the central station 12 detects the occurrence of a predetermined, and typically unexpected, event, such as the movement of a trailer 16*a* which should be stationary. Upon the detection of the predetermined event, the asset monitor can be configured to perform additional ones of its functions and/or to operate at a higher frequency or higher duty cycle in order to more closely monitor the predetermined event even though additional amounts of the limited energy stored by the energy storage reservoir 18 will be consumed.

In order to explain the operations of one embodiment of the asset monitor 14 in energy conservation mode, however, reference is now made to FIG. 4 in which the controller 28 initially determines if the asset monitor is ready to monitor the sensors 22 as shown in block 80. Typically, the controller will determine that the asset monitor is ready to monitor the sensors if it is presently one of the predetermined intervals of time during which the sensors are to be monitored. However, the asset monitor can also be instructed to monitor the sensors even though it is not presently one of the predetermined intervals of time, such as in instances in which a predetermined event has been detected and the relative frequency or relative duty cycle of the operations of the asset monitor has been increased.

If the asset monitor 14 is ready to monitor the sensors 22, the asset monitor can provide power to the respective sensors and can monitor the sensors, via the sensor interface 20, for a predetermined period of time, such as one minute, to detect any interrupts generated by the sensors, as shown in blocks 82 and 84. If any of the sensors have generated an interrupt within the predetermined period of time, the asset monitor can store the sensed data, such as the identification of the sensor generating the interrupt, the time and date at which the interrupt was generated and the most recent location of the container 16, as shown in block 86. The sensor can also provide sensory signals indicative of the actual conditions or events which were sensed. Thus, these types of sensory signals can also be stored by the asset monitor. Once all of the interrupts have been handled and the predetermined period of time has expired, the asset monitor typically powers down the sensors until the next predetermined interval of time for monitoring the sensors, as shown in block 88. Although not illustrated, however, the asset monitor can be configured to continue to provide power to and to continue to monitor at least some of the sensors even after the predetermined period of time has expired, such as in instances in which a predetermined event has been detected, without departing from the spirit and scope of the present invention.

Although not illustrated, the asset monitor 14 can be configured such that the sensed data is immediately transmitted to the central station 12 upon detection of an interrupt by the asset monitor. In this embodiment, the asset monitor would power up the communications transceiver 30 upon the detection of an interrupt and would transmit the sensed data to the central station for further processing. As described above, the asset monitor can, instead, store the sensed data until the next predetermined time at which the asset monitor is slated to communicate with the central station.

As shown in block 90 of FIG. 4, the controller 28 can thereafter determine if the asset monitor 14 is ready to update the location of the container 16. As described above, the controller will typically determine that the asset monitor is ready to update the location of the container if it is presently one of the predetermined intervals of time during which the location of the container is to be updated. However, the asset monitor can also be instructed to update the location of the container even though it is not presently one of the predetermined intervals of time, such as instances in which a predetermined event has been detected in a relative frequency or relative duty cycle of the operations of the asset monitor has been increased.

If the asset monitor 14 is ready to update the location of the container 16, the asset monitor can provide power to the position determining means, such as the GPS receiver 26, which, in turn, determines the present location of the container, as shown in blocks 92 and 94. Once the present location of the container has been stored by the asset monitor and/or transmitted by the asset monitor to the central station 12, the asset monitor can power down the GPS receiver in order to conserve energy, as shown in block 96. As described above, however, the asset monitor can be configured to continue to update the location of the container even after the predetermined period of time has expired, such as instances in which a predetermined event has been detected, without the spirit and scope of the present invention.

Finally, the controller 28 of this embodiment determines if the asset monitor 14 is ready to communicate with the central station 12, as shown in block 98 of FIG. 4. As described above, the controller will typically determine that the asset monitor is ready to communicate with the central station if it is presently one of the predetermined intervals of time during which the asset monitor is to communicate with the central station. However, the asset monitor can also be instructed to communicate with the central station even though it is not presently one of the predetermined intervals of time, such as instances in which a predetermined event has been detected in the relative frequency or relative duty cycle of the operations of the asset monitor as been increased.

If the asset monitor 14 is ready to communicate with the central station 12, the asset monitor can provide power to the communications transceiver 30, as illustrated in block 100. Thereafter, the asset monitor and the central station can communicate via the first communications link for a predetermined period of time, as shown in block 102. During this predetermined period of time, the asset monitor preferably responds to any request from the central station in a like manner to that described above, as depicted in block 104. Once the predetermined period of time for communications between the asset monitor and the central station has expired, the asset monitor powers down the communications transceiver, as shown in block 106. As described above, however, the asset monitor of an alternative embodiment can be configured to provide power to the communications transceiver to communicate with the central station following the detection of an interrupt by predetermined ones of the sensors or upon the detection of predetermined event, such as an unanticipated change in the location of the container 16, without departing from the spirit and scope of the present invention.

As also shown in block 108 of FIG. 4, the controller 28 can thereafter determine if the asset monitor 14 is still electrically untethered from the external power source. If so, the asset monitor continues to operate in the energy conservation mode as illustrated in FIG. 4. If the container 16 has recently been electrically tethered to the external power source, however, the asset monitor is placed in the active mode as shown in FIG. 3 and the energy storage reservoir 18 of the asset monitor is recharged by the external power source.

In addition to the communications means 40, such as a transceiver, the central station 12 shown in FIG. 2 also includes a controller 42 for receiving and processing information from the various asset monitors 14 in the field. As shown in FIG. 2, the central station can also include a data entry device 44, such as a keyboard, a memory device 46 and a display 48 for entering, storing and displaying data, respectively.

For example, the central station 12 can organize and prepare reports of varying levels of detail based upon the information received from each respective asset monitor 14 in order to assist or advise the owners of a fleet while the freight continues along its route. In addition, the central station can display the present and historical location of the respective container 16 as an overlay on a computer generated map to further assist the owners of the freight to track a particular container and to assess route usage, asset deployment and other operational parameters of value and interest.

The central station 12 can also process the received data and, in particular, the data relating to the actual conditions or events sensed by the on-board sensors to detect trends, such as a refrigerated truck which is gradually warming, and/or to detect sensed conditions which exceed or fall outside of acceptable limits. Based upon an evaluation of the received data, the central station can then advise the asset monitor 14 and, in turn, the operator of the tractor 16*b* of potential or upcoming problems with the freight, such as by transmitting a warning message to the asset monitor and, in turn, to the operator of the tractor. In addition, the data received by the central station which relates to the actual on-board conditions or events can serve as a log for insurance purposes so as to assist the owner of the freight in determining the party responsible and the reasons for any damage which their freight sustained.

The central station 12 can also produce a variety of reports based upon the received data which are tailored or customized according to the unique business requirements of a particular customer. By more closely monitoring the remotely located containers 16, the central station can provide status reports which allow the owners of the containers to more efficiently utilize the containers, thereby increasing the overall system productivity.

While the controller 42 and related memory devices 46 of the central station 12 can be organized in different manners without departing from the spirit and scope of the present invention, the controller of one embodiment is adapted to manage a large scale relational data base, thereby supporting a variety of tables that link fields containing data of interest to the dispatcher or the owners of the freight. For example, the controller of the central station can include a Microsoft NT server.

According to one advantageous aspect of the present invention, the asset monitoring system 10 also includes an operator interface 50 for providing information to and receiving information from an operator. For example, the operator interface can be mounted within the cab of a tractor 16*b* and can be adapted to communicate with the asset monitor 14 disposed within the trailer 16*a* which is hitched or tethered to the tractor. In particular, the operator interface and the asset monitor can each include local communications means, such an RF, IR or audio transceiver, for establishing a second communications link.

The operator interface 50 can also include a controller 52, such as one or more microcontrollers or microprocessors, for controlling the operations of the operator interface and for processing data received from the asset monitor. Moreover, the operator interface can include a data entry device 55, such as a optical scanner, an RF tag sensor and/or a keyboard, for allowing the operator to enter data. This operator-entered data can then be transmitted, via the second communications link, to the asset monitor 14 for subsequent processing, storage and/or transmission, via the first communications link, to the central station 12.

For example, the operator can enter and transmit data via the first and second communications links which identifies or otherwise relates to the cargo stowed within the container 16. Thus, the central station 12 and/or the asset monitor 14 can monitor the status of the cargo and can pinpoint the times at which the cargo was loaded and delivered. In addition, the operator can enter and transmit messages via the first and second communications links which alert the dispatcher and/or emergency service personnel of a situation, such as a traffic accident or a fire, which demands emergency assistance.

The data entry device 55 of the operator interface 50 can also include an emergency or panic button which, when depressed, transmits a signal to the central station advising the dispatcher of the need for emergency assistance. In addition to the communications means 54, such as a transceiver, the operator interface can also include a display 56 and one or more memory devices 58 for displaying and storing data, respectively.

Although not illustrated, the operator interface 50 and, more particularly, the controller 52 can be associated with one or more sensors, such as one or more engine sensors for monitoring predetermined engine conditions, such as oil pressure and/or engine temperature. The operator interface can then transmit the sensory data provided by the sensors, via the second communications link, to the asset monitor 14 for storage, processing, and/or transmission to the central station 12 via the first communications link.

In addition to transmitting or passing information received from the operator interface 50 to the central station 12, the asset monitor 14 can provide the operator of the tractor 16*b* with helpful information via the operator interface. For example, the asset monitor can provide a warning to the operator if the asset monitor has received an interrupt from one or more of the trailer sensors 22. If desired, this warning can also include a message which identifies the remedial action to be undertaken by the operator.

The central station 12 can also communicate with the operator of the tractor 16*b*, via the communications links established by the asset monitor 14 and the operator interface 50. For example, the central station can redirect the tractor-trailer by transmitting a message detailing the new route and the revised destination via the first communications link from the central station to the asset monitor which, in turn, retransmits the message, via the second communications link, to the operator interface. In addition, the central station can periodically provide the operator interface with location data which identifies the present location of the trailer, such as by street location or by city and state.

While the asset monitoring system 10 and method of the present invention is extremely useful during tethered periods in which the asset monitor 14 is electrically tethered to an external power source 15, such as the electrical system of a tractor or truck 16*b*, the asset monitoring system and method of the present invention provides particularly advantageous results during untethered periods during which the asset monitor is electrically untethered or disconnected from any external power source. During these untethered periods, the asset monitoring system and method can continue to perform selected ones of its operations.

As a result, the asset monitor 14 can identify the present location of the container 16, such as the present location of an unhitched or parked trailer 16*a*, as well as providing sensory data signals indicative of the current status of the container and its contents. Accordingly, the location of the container and the status of its contents can be monitored and managed from a remotely located central station 12 even after the container and, more particularly, the asset monitor has been electrically untethered or disconnected from any external power source. The asset monitoring system 10 and method of one present invention therefore allows lost, stolen or otherwise misplaced containers to be located and retrieved such that the contents of the containers can be appropriately delivered. Moreover, the asset monitoring system and method of the present invention provides both shippers and the owners of the freight with a great degree of assurance since the location and status of the trailer and, therefore, the freight can be monitored, even after the container has been electrically untethered or disconnected from any external power source.

While particular embodiments of the invention have been described, it will be understood, however, that the invention is not limited thereto, since modifications may be made to those skilled in the art, particularly in light of the foregoing teachings. It is, therefore, contemplated by the appended claims to cover any such modifications that incorporate those features or these improvements which embody the spirit and scope of the present invention.

That which is claimed is:

1. An asset monitoring system comprising:

a central station;

at least one asset monitor associated with a respective container for providing said central station with information relating to the respective container, wherein said at least one asset monitor comprises:

an energy storage reservoir which as recharged by energy received from an external power source during tethered periods in which said asset monitor is electrically tethered to the external power source, wherein said energy storage reservoir is adapted to supply energy to maintain said asset monitor in operation during both tethered periods in which said energy storage reservoir is recharged by the external power source and untethered periods in which said asset monitor is electrically untethered from the external power source; and a controller for controlling operations of said asset monitor, wherein said controller comprises;

tether status determining means for separately identifying tethered periods and untethered periods; and power management means, responsive to said tether status determining means, for placing said asset monitor in an active mode during tethered periods and an energy conservation mode during untethered periods, wherein said power management means manages recharging of said energy storage reservoir during the active mode, and wherein said power management means selectively permits power to be drawn from said energy storage reservoir during the energy conservation mode, thereby allowing at least some of the operations of said asset monitor to be performed during the energy conservation mode;

a sensor interface, operably connected to said controller, for communicating with at least one sensor which is associated with the container, wherein said power management means only provides power to the at least one sensor for predetermined periods of time during the energy conservation mode such that communication is only established between said controller and the at least one sensor within the predetermined periods of time during the energy conservation mode; and communications means for establishing a first communications link between said at least one asset monitor and said central station.

2. An asset monitoring system according to claim 1 wherein the at least one sensor is adapted to provide a predetermined type of sensory signal, and wherein said communications means is adapted to transmit information related to the sensory signal to the central station via the first communications link.

3. An asset monitoring system according to claim 2 wherein said asset monitor is adapted to transmit a warning signal via the first communications link to said central station in response to receipt of predetermined types of sensory signals by said controller.

4. An asset monitoring system according to claim 2 further comprising an operator interface, wherein said communications means also establishes a second communications link between said asset monitor and said operator interface, and wherein said asset monitor is adapted to transmit a warning signal via the second communications link to said operator interface in response to receipt of predetermined types of sensory signals by said controller.

5. An asset monitoring system according to claim 1 wherein at least one sensor associated with the container is adapted to provide a respective interrupt signal to said sensor interface in response to a predetermined event.

6. An asset monitoring system according to claim 1 wherein said at least one sensor is selected from the group consisting of a temperature sensor, a door position sensor, a tire pressure sensor, a volume sensor and position determining means.

7. An asset monitoring system according to claim 1 wherein said asset monitor further comprises a timer, and wherein said power management means is responsive to said timer for permitting increased levels of power to be drawn from said energy storage reservoir during predetermined intervals of time during the energy conservation mode.

8. An asset monitoring system according to claim 7 wherein said communications means comprises a communications receiver associated with said asset monitor for receiving signals from said central station, and wherein said power management means activates said receiver during predetermined intervals of time within the energy conservation mode to detect signals transmitted to said asset monitor from said central station.

9. An asset monitoring system according to claim 1 wherein said asset monitor further comprises position determining means, operably connected to said controller, for determining the position of the container based upon externally supplied location data.

10. An asset monitoring system according to claim 9 wherein said position determining means comprises a receiver for receiving signals from a plurality of global positioning satellites which provide location data from which the position of the container is determined.

11. An asset monitoring system according claim 9 wherein said communications means is adapted to transmit the position of the container to said central station via the first communications link.

12. An asset monitoring system according to claim 9 further comprising an operator interface, and wherein said communications means also establishes a second communications link between said asset monitor and said operator interface.

13. An asset monitoring system according claim 12 wherein said communications means is adapted to transmit location data relating to the position of the container to said operator interface via the second communications link.

14. An asset monitor for monitoring an associated container, the asset monitor comprising:

an energy storage reservoir which is recharged by energy received from an external power source during tethered periods in which the asset monitor is electrically tethered to the external power source, wherein said energy storage reservoir is adapted to supply energy to maintain the asset monitor in operation during both tethered periods in which said energy storage reservoir is recharged by the external power source and untethered periods in which the container is electrically untethered from the external power source; and a controller for controlling operations of the asset monitor, wherein said controller comprises:

tether status determining means for separately identifying tethered periods and untethered periods; and power management means, responsive to said tether status determining means, for placing the asset monitor in an active mode during tethered periods and an energy conservation mode during untethered periods, wherein said power management means selectively permits power to be drawn from said energy storage reservoir during the energy conservation mode, thereby allowing at least some of the operations of the asset monitor to be performed during the energy conservation mode;

a sensor interface, operably connected to said controller, for communicating with at least one sensor which is associated with the container, wherein said power management means only provides power to the at least one sensor for predetermined periods of time during the energy conservation mode such that communication is only established between said controller and the at least one sensor within the predetermined periods of time during the energy conservation mode.

15. An asset monitor according to claim 14 further comprising communications means for establishing a first communications link between the asset monitor and a central station.

16. An asset monitor according to claim 15 wherein the at least one sensor is adapted to provide a predetermined type of sensory signal, and wherein said communications means is adapted to transmit information related to the sensory signal to the central station via the first communications link.

17. An asset monitor according to claim 16 wherein said asset monitor is adapted to transmit a warning signal via the first communications link to the central station in response to receipt of predetermined types of sensory signals by said controller.

18. An asset monitor according to claim 16 wherein said communications means also establishes a second communications link between said asset monitor and an operator interface, and wherein said asset monitor is adapted to transmit a warning signal via the second communications link to the operator interface in response to receipt of predetermined types of sensory signals by said controller.

19. An asset monitor according to claim 15 further comprising a timer, and wherein said power management means is responsive to said timer for permitting increased levels of power to be drawn from said energy storage reservoir during predetermined intervals of time during the energy conservation mode.

20. An asset monitor according to claim 19 wherein said communications means comprises a communications receiver associated with said asset monitor for receiving signals from the central station, and wherein said power management means activates said receiver during predetermined intervals of time within the energy conservation mode to detect signals transmitted to said asset monitor from the central station.

21. An asset monitor according to claim 15 wherein said asset monitor further comprises position determining means, operably connected to said controller, for determining the position of the container based upon externally supplied location data.

22. An asset monitor according to claim 21 wherein said position determining means comprises a receiver for receiving signals from a plurality of global positioning satellites which provide location data from which the position of the container is determined.

23. An asset monitor according claim 21 wherein said communications means is adapted to transmit the position of the container to said central station via the first communications link.

24. A method of providing a remotely located central station with information relating to at least one container, the method comprising the steps of:

identifying tethered periods during which the asset monitor is electrically tethered to an external power source and untethered periods during which the asset monitor is electrically untethered from an external power source;

if a tethered period is identified, the method further comprising the steps of:

drawing power from an energy storage reservoir;

drawing power from the external power source to recharge the energy storage reservoir;

monitoring at least one sensor associated with the container to collect sensory signals provided by the sensor; and transmitting information relating to the sensory signals collected during said monitoring step to the central station, wherein said monitoring and transmitting steps are performed at a first rate during the tethered periods; and if an untethered period is identified, the method further comprising the steps of:

drawing power from the energy storage reservoir without recharging the energy storage reservoir;

monitoring at least one sensor associated with the container to collect sensory signals provided by the sensor, wherein said monitoring step performed during an untethered period comprises the steps of:

providing power to the at least one sensor only during predetermined intervals of time within the untethered periods and monitoring the at least one sensor during the predetermined intervals of time to collect sensory signals transmitted by the respective sensors; and transmitting information relating to the sensory signals collected during said monitoring step to the central station, wherein said monitoring and transmitting steps are performed at a second rate during the untethered periods.

25. A method according to claim 24 wherein the sensors are adapted to provide respective interrupt signals upon the detection of predetermined events, and wherein said monitoring step performed during the predetermined intervals of time within an untethered period comprises the step of monitoring the at least one sensor to detect an interrupt generated by the at least one sensor.

26. A method according to claim 24 wherein said transmitting steps comprise the step of transmitting a warning signal to the central station in response to the receipt of predetermined types of sensory signals.

27. A method according to claim 24 wherein said transmitting steps comprise the step of transmitting a warning signal to an operator interface in response to the receipt of predetermined types of sensory signals.

28. A method according to claim 24 further comprising the steps of:

determining the position of the container based upon externally supplied location data; and transmitting information relating to the position of the container to the central station.

29. A method according to claim 24 wherein said transmitting steps further comprise the step of transmitting information to an operator interface which relates to at least one of the position of the container and at least portions of the sensory signals.

30. A method according to claim 24 further comprising the step of drawing increased levels of power from the energy storage reservoir during predetermined intervals of time during an untethered period.

31. A method according to claim 24 further comprising the step of storing information relating to the sensory signals collected during said monitoring steps performed during the tethered and untethered periods.

* * * * *